United States Patent [19]

Vasilantone

[11] 3,971,347

[45] July 27, 1976

[54] ROTARY INTERNAL COMBUSTION ENGINE

[76] Inventor: Michael Vasilantone, 147 E. First Ave., Roselle, N.J. 07203

[22] Filed: Oct. 10, 1973

[21] Appl. No.: 405,183

[52] U.S. Cl. ..... 123/8.45; 418/147; 418/267; 418/269

[51] Int. Cl.[2] ..... F02B 53/00

[58] Field of Search ..... 123/845; 418/145, 147, 418/148, 266, 267, 268, 269, 176, 173

[56] References Cited

UNITED STATES PATENTS

| | | | |
|---|---|---|---|
| 1,093,005 | 4/1914 | Myers | 418/269 X |
| 1,453,683 | 5/1923 | Kochendorfer | 418/266 |
| 1,607,505 | 11/1926 | Bentley | 418/147 X |
| 3,437,079 | 4/1969 | Odawara | 123/8.45 X |

FOREIGN PATENTS OR APPLICATIONS

| | | | |
|---|---|---|---|
| 1,286,068 | 1/1962 | France | 418/173 |

*Primary Examiner*—Carlton R. Croyle
*Assistant Examiner*—Michael Koczo, Jr.
*Attorney, Agent, or Firm*—Edward E. Dyson; John J. Byrne

[57] ABSTRACT

A rotary internal combustion engine comprising a cylindrical housing comprised of an annular intermediate member and a pair of end plates, one on each side of the annular member, and defining an enclosed, generally cylindrical, rotor chamber. A shaft is journaled in the end plates and extends through the chamber. A rotor is fixed to the shaft for rotation therewith in the rotor chamber. The rotor chamber is concentric with the housing, while the rotor and shaft are concentric and eccentrically disposed relative to the chamber and housing. Pivoted vane elements are mounted on the periphery of the rotor and are biased into engagement with the annular wall of the rotor chamber and sequentially form intake, compression, combustion and exhaust chambers between the rotor and the annular wall. The vanes include resilient elements having bent-back portions which engage the annular wall to provide seals between the sequentially formed chambers. The annular wall is provided with a plurality of rings which are engaged by the resilient elements of the vanes and which rotate with the vanes to minimize frictional contact.

13 Claims, 7 Drawing Figures

Fig. 1
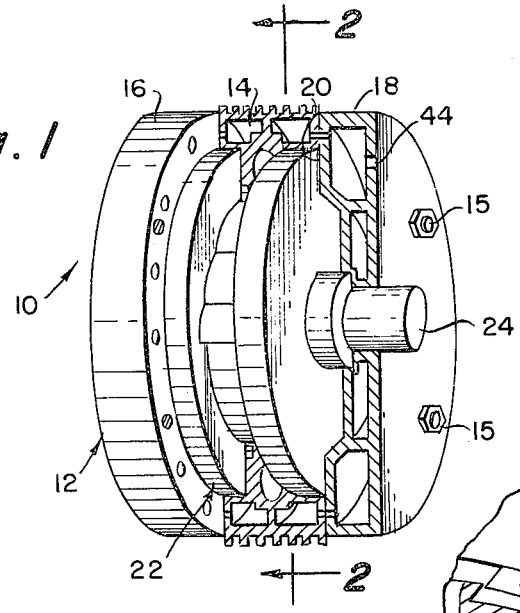
Fig. 4
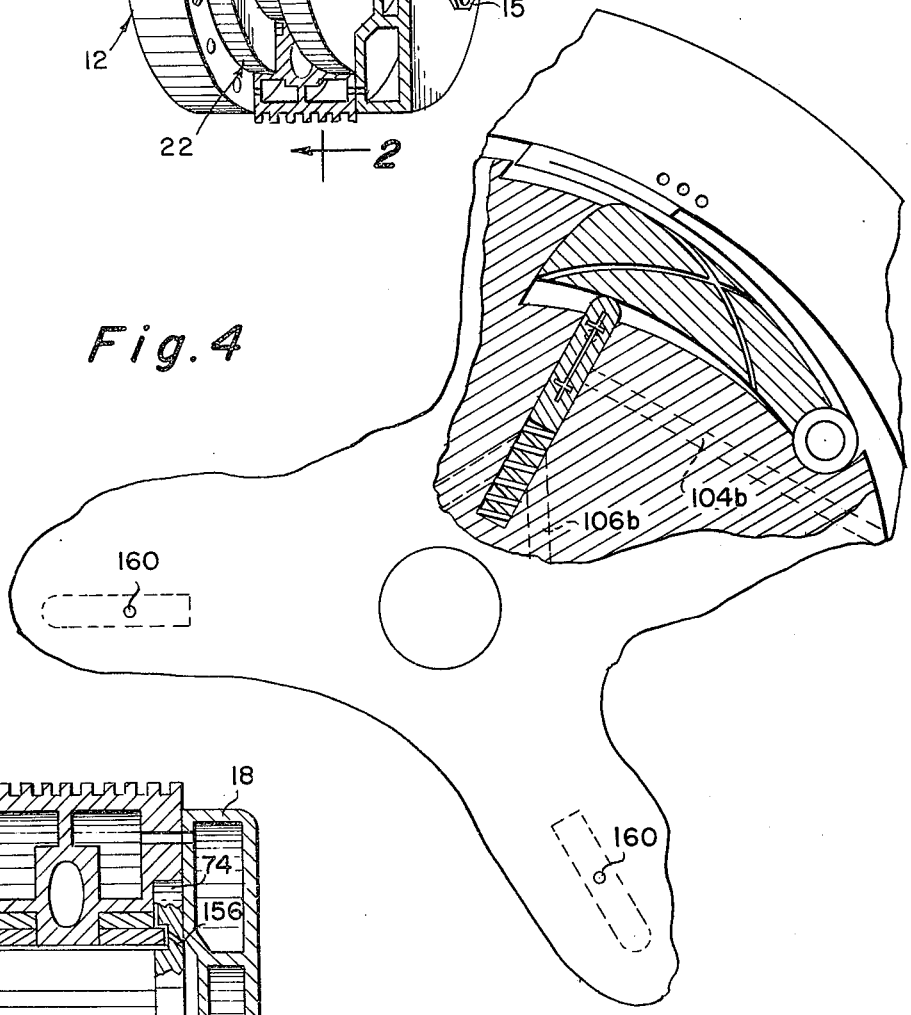
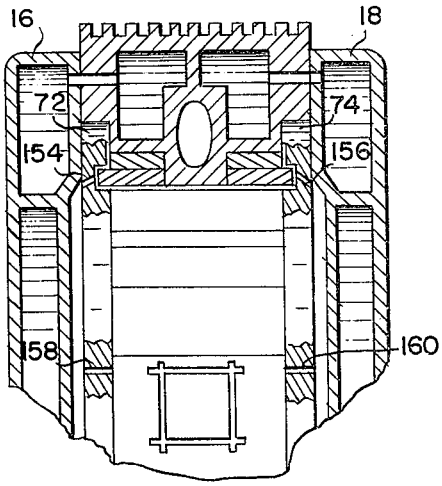
Fig. 5

ROTARY INTERNAL COMBUSTION ENGINE

The invention relates to internal combustion engines and more particularly to rotary internal combustion engines.

The internal combustion engine of this invention comprises a housing and a concentrically arranged chamber within said housing receiving an eccentrically disposed cylindrical rotor. The rotor cooperates with the chamber to define a crescent-shaped chamber and is sequentially divided into intake, compression, combustion and exhaust chambers by means of vanes which are pivotally mounted on the annular surface of the rotor and engage the inner surface of the housing which defines the chamber.

There has been much experimentation and developmental work conducted in the area of rotary internal combustion engines. The main benefits to be derived from rotary internal combustion engines relative to reciprocating piston engines are that they are comprised of fewer operating parts, can be run on a number of different fuels, are more compact and are more efficient.

One of the major problems with existing rotary engines is in providing an effective seal between the various chambers. The seal must prevent the intermingling of the gases between chambers to insure substantially complete combustion of the fuel, and must be durable to withstand the constant frictional contact with the inner surface of the housing. This problem has been overcome somewhat in the prior art by designing a rotor which moves in an orbital path relative to the housing to provide substantially rolling contact as opposed to rubbing or frictional contact between the sealing surfaces. However, it is more desirable to provide a rotor which moves in a rotational path as opposed to an orbital path for greater driving efficiency between the motor and the drive shaft. In other words, it is much simpler to take off torque from a rotating body than from one that is moved in an orbital path. Also, in the prior art, because of the frictional contact, there is great heat build-up which must be dissipated in some manner. The heat build-up impairs the operating efficiency of the engine and is injurious to the engine parts.

It is an objective of this invention to overcome the above-described disadvantages of internal rotary combustion engines of the prior art, and to provide a more efficient engine.

More particularly, it is an objective of this invention to provide a rotary internal combustion engine having improved sealing means between the rotor and the stator or housing.

It is a further objective of this invention to provide means in a rotary internal combustion engine wherein frictional contact and, therefore, heat buildup is effectively minimized.

It is a further objective of this invention to provide an improved rotor of greater rigidity and strength in a rotary internal combustion engine.

These and other objects of the invention will become more apparent to those skilled in the art by reference to the following detailed description when viewed in light of the accompanying drawings wherein:

FIG. 1 is a partial cross sectional view in perspective of the rotary internal combustion engine of this invention;

FIG. 4 is a side view in elevation partially in cross section particularly emphasizing the vane construction of the rotary internal combustion engine of this invention;

FIG. 5 is a fragmentary view showing the particular mode of oil distribution to the torque rings and the vanes;

Figure 3:
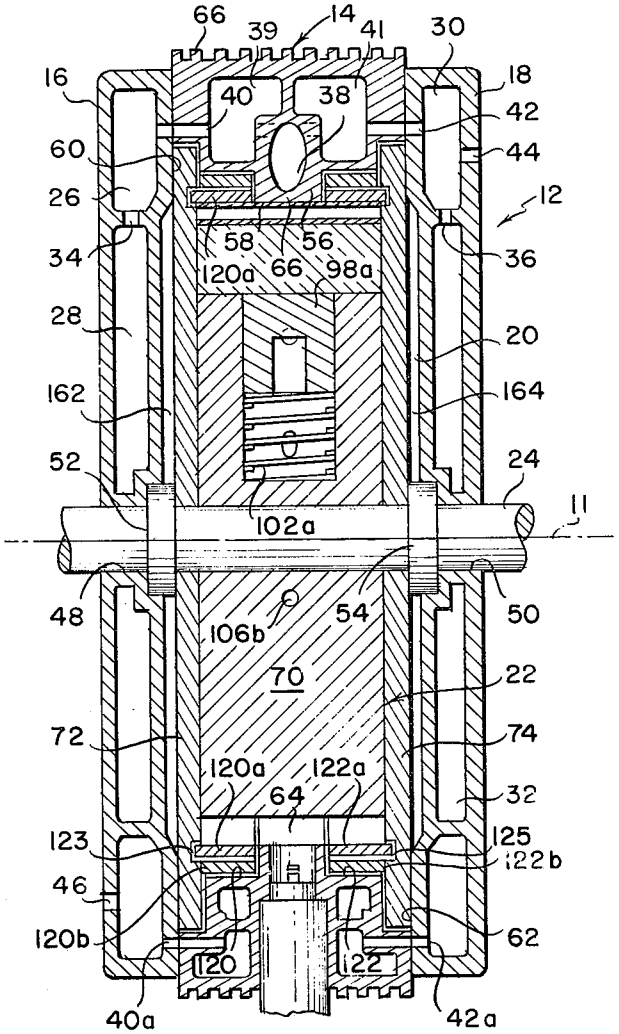
FIG. 3 is a cross sectional view of the rotary internal combustion engine of this invention taken along lines 3—3 of FIG. 2.

Referring now to the drawings wherein like numerals indicate like parts, the internal combustion engine of this invention is generally indicated by the numeral 10 and includes a housing 12 comprised of an intermediate member 14 and a pair of end plates 16 and 18, one on each side of the intermediate member 14. The end plates are joined to the intermediate member by any suitable means preferably elongated bolts 15 which extend through openings in the end plates and the intermediate member. The housing has an enclosed rotor chamber 20 which receives a rotor generally indicated by the numeral 22. The rotor is fixed to a shaft 24 which is journaled in the end plates 16 and 18.

As can best be seen with reference to FIG. 3, the end plates 16 and 18 are provided with internal annular passageways 26, 28, 30 and 32 through which flows the engine coolant. The passageways 26, 28, 30 and 32 are connected by passageways 34 and 36. Also, the intermediate member 14 is provided with coolant passageways 38, 39 and 41 which receive coolant from passageways 40 and 42 at the top side thereof and **40*a* and 42*a* at the bottom side. Coolant is pumped in from a suitable source to the passageway 30 through inlet 44 and exits from the motor at 46. The passageways for cooling the engine may be arranged in any suitable manner necessary to perform the cooling function efficiently. For the most part, the cooling arrangement shown is merely a schematic illustration it being understood that other arrangements can be employed. The end plates 16 and 18 are provided with central openings 48 and 50 which receive the shaft 24. The shaft is journaled in the end plates by anti-friction bearing elements 52 and 54 and the rotor 22 is keyed to the shaft 24** for rotation therewith.

The intermediate member 14 is T-shape in cross section and includes a vertical leg portion 56, the bottom of which forms an annular wall 58 which is engaged by the vanes of the rotor as will be described in more detail hereinafter.

The T-shaped intermediate member 14 divides the chamber 20 axially into first and second sections 60 and 62 which are of equal diameter, and a third section 64 which is intermediate the sections 60 and 62 and which is of a diameter less than that of the sections 60 and 62, the differencee being the height of the vertical leg section 66 of the T-shaped member 14. The member 14 is provided with heat-dissipating fins 66 about its exterior peripheral surface. The T-shaped member 14 is also provided with fuel inlets, a sparkplug opening and an exhaust outlet as will be described in detail more fully below.

The rotor 22 is of a spool configuration and includes a central portion 70 and end discs 72 and 74. Central portion 70 is surrounded by the annular wall 58 while the disc members 72 and 74 are received within the first and second sections 60 and 62 of the chamber 20.

Figure 2:
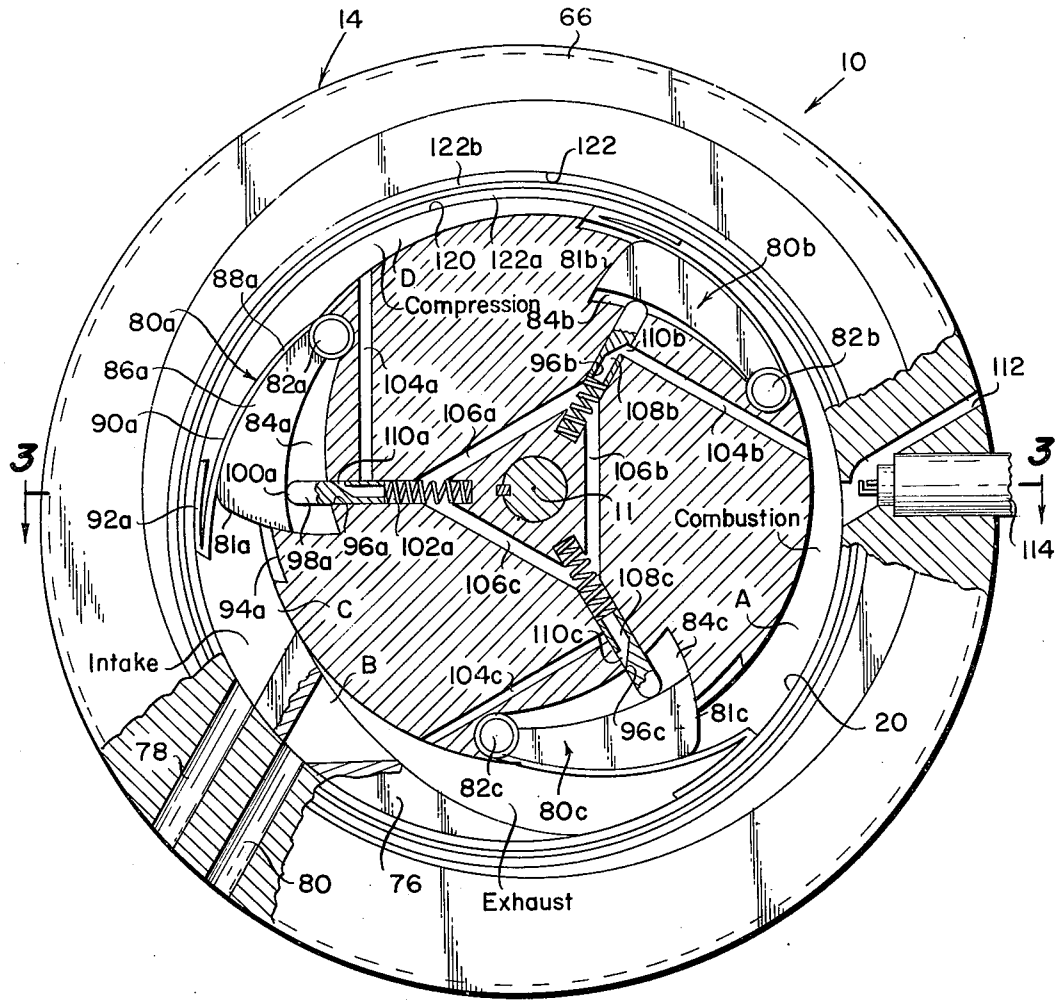
FIG. 2 is a cross sectional view of the rotary internal combustion engine of this invention taken along lines 2—2 of FIG. 1.

The third section 58 of the chamber 20 is defined by the bottom surface or annular wall 58 of the T-shaped member 14 and is eccentric relative to the axis 11 of the rotor 22. The section 60 and section 62, however, of the chamber 20 are concentric with the rotor. With reference to FIG. 2, because of the eccentric relationship of the T-shaped member relative to the rotor, a crescent-shaped chamber is formed between the inner surface 58 of the T-shaped member and the rotor 22 interrupted only by a purge block 76 which extends radially inwardly in the area of the exhaust port 80. On the side substantially diametrically opposed to the exhaust port 80, the rotor 22 comes into its closest contact with the inner surface 58 of the T-shaped member 14.

With particular reference to FIG. 2, the rotor 22, and more particularly the central member 70, is provided with three vanes 80*a*, 80*b*, and 80*c*. The vanes are pivotally mounted at 82*a*, 82*b*, 82*c* by a hinge pin or the like and are received in recesses 84*a*, 84*b*, and 84*c*. Each of the vanes are identical and will be described with reference to vane 80*a*. Vane 80*a* comprises a body portion 86*a* and an overlying resilient member 88*a* comprised of a flat metal spring. The resilient member 88*a* is suitably secured to the body portion 86*a* and comprises a first elongated section 90*a* which extends beyond the free end of the body portion 86*a* and terminates in a bentback portion 92*a*. It is the bent-back portion 92*a* which engages the annular wall 58 defined by the T-shaped member 14. The recess 94*a* is provided in the rotor 22 to receive that portion of the resilient member 88*a* which extends beyond the body portion 86*a*. Accordingly, when the vanes are fully retracted within the recesses, a substantially continuous rotor surface is presented. Underlying the vane 80*a* is a radially extending rectangular slot 96*a* which receives a generally rectangular piston 98*a* having a rounded nose portion 100*a*. The piston 98*a* is slidably received within the slot 96*a* and is urged to the outward position and into engagement with the underside of the vane 80*a* by means of a coiled spring 102*a*. Intersecting the slot 96*a* is a passageway 104*a* which opens at its other end into the periphery of the rotor 22, at a point immediately preceding the vane 80*a*, it being understood that the rotor rotates in a clockwise direction. As indicated earlier, each of the vane arrangements are identical and also are provided with similar passageways 104*b* and 104*c*. The slots 96*a*, 96*b* and 96*c* are communicated with each other via passageway 106*a*, 106*b* and 106*c*. The piston 98*a*, includes an internal passageway 108*a* which at one end opens into the bottom of the piston and at its other end opens into orifice 110*a* on the side of the piston adjacent to the passageway 104*a* so that during some point of travel of the piston 98*a*, the orifice 110*a* comes into registry with the passageway 104*a*. In the position depicted in the drawing, passageway 104*b* and orifice 110*b* of vane 80*b* are in registry.

The vanes 80*a*, 80*b* and 80*c* divide the crescent-shaped chamber, defined by the eccentric T-shaped member and the rotor, sequentially into a combustion chamber A, an exhaust chamber B, an intake chamber C, and a compression chamber D. The purge member 76 is in constant engagement with the rotor surface and separates and seals the exhaust chamber B from the intake chamber C. The purge member is comprised of a bulge in the vertical leg of the T-shaped member 14 and pushes the vane back into its recesses so that it is substantially flush with the surface of the rotor 22.

Fuel and air from a carburetor, not shown, is introduced to chamber C through intake 78 which immediately follows the purge block 76. The fuel and air may be introduced in a precompressed state. The air and fuel compressed during the compression stage is released and ignited by the sparkplug 114. The compression ratio can be varied initially by assemblying the rotor in the housing at a point closer to the point of combustion. Supplemental fuel can be injected directly through port 112 to prime the combustion chamber. The forces produced by the expanding gases of combustion act on the faces 81*a* 81*b* and 81*c* of the pivotal vanes to push the rotor in the clockwise direction. The combustion gases also enter passageway 104*b* which at the particular stage shown in FIG. 2 is in registry with orifice 110*b*. The combustion gases flow through the passageway 108*b*, the slot 96*b* and through passageways 106*a* and 106*b* to the slots 96*a* and 96*c* to act on the undersurface of the pistons 98*a* and 98*c*. The pistons push the vanes to the outward position against the annular wall 58 of the T-shaped member 14. This helps insure adequate sealing engagement between the bent-back portion 92*a* of the flexible member 88*a* to provide an effective seal between the various stages. The passageways in the pistons are dimensioned and located as to come into registry with the passageways 104*a* through 104*c* at the proper moment to permit the entry of combustion gases to the slots underlying the other vanes.

The flexible member 88*a*, made of flat spring steel, helps absorb the impact created by rapid pivotal movement of the valve against the annular wall 58 of the T-shaped member. Additionally, the members conform to the irregularities of the inner surface of wall 58 and provide a broad-based contact area for sealing purposes. In other words, the length of the bent-back member 98*a* is such that sealing is provided over a substantial distance of the surface of wall 58. This is in contrast to the line contact type sealing elements of the prior art.

To help reduce the frictional contact between the flexible members and the annular wall 58 of the T-shaped member, annular recesses 120 and 122 are provided in the inner surface 58 of the T-shaped member 14 and receive concentric torque rings 120*a* and 120*b* and 122*a* and 122*b* respectively. These rings are made of a metallic material and are free to rotate relative to each other and within the recesses 120 and 122. Rings 120*a* and 122*a* are wider than rings 120*b* and 122*b* and the outer peripheral edges thereof are received in annular slots 123 and 125 in the discs 72 and 74. The purpose of the wider rings is to more effectively seal the chambers against leakage. The bent-back portions 92*a–c* of the pivotal vanes ride on the torque rings 120*a* and 122*a* and these rings rotate with the vanes, though there is some slippage. There is a tendency for the concentric rings 120*b* and 122*b* to rotate with the inner rings 120*a* and 122*a*. However, there is even more slippage between these rings such that the inner rings 120*b* and 122*b* are traveling at a lesser speed than the outer rings, and, accordingly, there is less rubbing contact and less heat buildup between the T-shaped member and the inner rings 120*b* and 122*b* because of the reduced speed. The bent-back portions 92*a* of the van member are substantially entirely supported by the torque rings although for all practical purposes there is no gap between that portion of the undersurface 58 which is exposed to the bent-back portion 92*a* to effectively maintain a tight seal. The purpose is to minimize frictional contact and heat buildup and this is accomplished since the rings have a tendency to rotate with the vanes. Additionally, the torque rings as well as the rotor discs 72 and 74 help to carry away heat from the combustion zone area.

Figure 6:
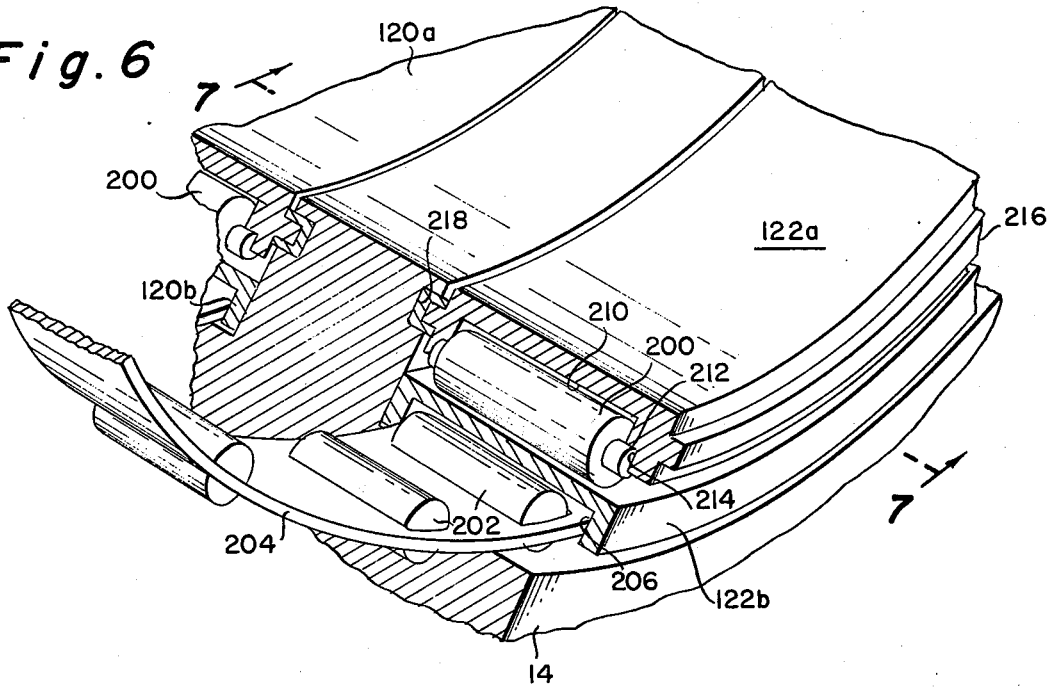
FIG. 6 is a fragmentary perspective view of a modified torque ring embodiment.
Figure 7:
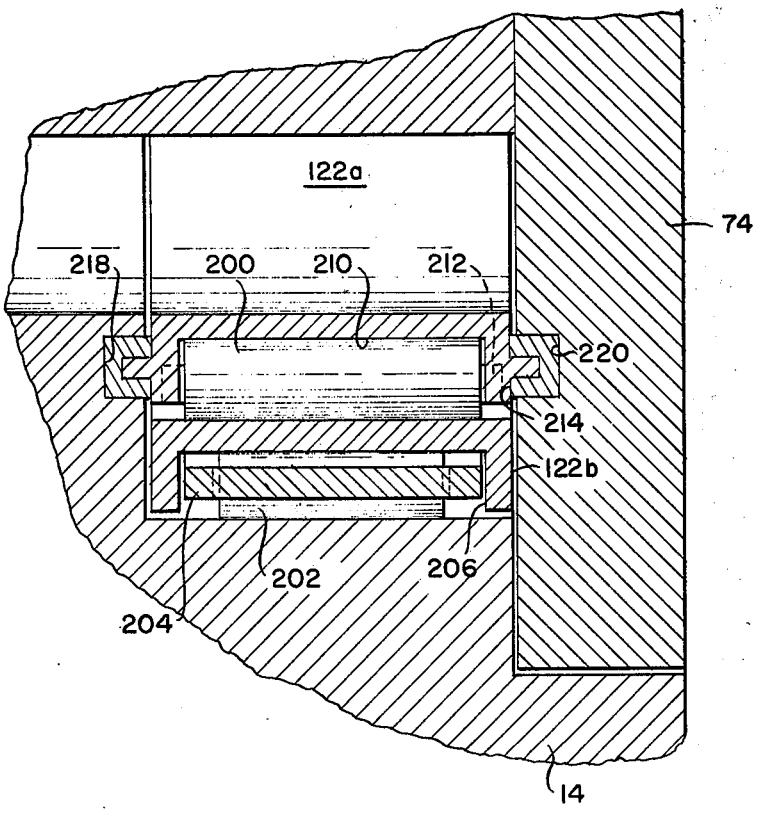
FIG. 7 is a fragmentary view in elevation approximately along lines 7—7 of FIG. 6 but with the rotor in position.

A modified form of the torque ring arrangement is shown in FIGS. 6 and 7. These modified forms employ anti-friction devices in the form of a string of rollers 200 which are disposed between the rings 120*a* and 122*a* and the rings 120*b* and 122*b* and by strings of rollers 202 which are disposed between the outer rings 120*b* and 122*b* and the intermediate member 14. Rollers 202 are held captive in races 204 and the entire assembly is received in a groove 206 extending around the outer periphery of each of the rings 120*b* and 122*b*. The rollers 200 are received in a peripheral recess 210 and are provided with stub axles 212 which ride in trackways 214 cut in the side walls of the channel 210. It may also be noted in this particular modification that the radially inwardmost rings 120*a* and 122*a* are provided with ribs 216 on their opposite sidewalls which are received in grooves 218 in the intermediate member 14 and grooves 220 in the discs 74 and 76 of the rotor.

As may be apparent with reference to the modified embodiment, the radially innermost torque rings are always frictionally engaged with at least two pivotal vanes at any one time causing the ring to revolve with the rotor. The provision of the two lines of rollers further minimizes frictional contact and heat buildup.

The oil porting arrangements can best be understood with reference to FIGS. 3 through 5. Oil cavities 162 and 164 are provided in the end plates 16 and 18 respectively and are defined by annular centrally located depressions within the end plates and by the side walls of the disc elements 72 and 74 of the rotor 22. As seen in FIG. 5, passageways 154 and 156 in the end plates 72 and 74 communicate the oil reservoirs with the T-shaped ring member in the area of the torque rings while passageways 158 and 160 communicate with the reciprocating pistons 98*a–c*. It is to be understood that there are passageways for each of the vanes which correspond to passageway 158 and 160.

It can be seen that the rotary internal combustion engine of this invention provides effective sealing in the areas between the respective combustion, intake, compression and exhaust chambers, with minimal frictional contact and heat buildup between the rotating parts. It is to be understood that in the alternative, the apparatus of this invention can be used as a compressor when driven by an external power source.

In a general manner, while there has been disclosed effective and efficient embodiments of the invention, it should be well understood that the invention is not limited to such embodiments as there might be changes made in the arrangement, disposition, and form of the parts without departing from the principle of the present invention as comprehended within the scope of the accompanying claims.

I claim:

1. In a rotary internal combustion engine, a cylindrical housing, said housing comprising an annular, ring-like intermediate member, a pair of end plates, one on each side of said annular member and defining an enclosed rotor chamber therewith, a shaft journaled in said end plates and extending through said chamber, a rotor in said rotor chamber and fixed to said shaft for rotation therewith, said rotor chamber being ecentric relative to said rotor to define a crescent-shaped chamber, pivoted vane elements on said rotor and biased into engagement with the annular wall of said rotor chamber as defined by the inner surface of said annular member, and sequentially forming intake, compression, combustion and exhaust chambers in said crescent shaped chamber, each comprising a body portion pivoted to said rotor and a resilient element for engaging said annular wall, said resilient element including a first elongated section attached to said body member and a second integral section bent back from said elongated section in the reverse direction, said second section engaging said annular wall, first passageway means in said housing to admit fuel to said combustion chamber and air to said intake chamber, and power means in said rotor for forcing said vanes into engagement with said annular wall comprising radially extending slots in said rotor and underlying said vanes, reciprocating pistons received in said slots and movable into engagement with the underside of said vanes, and second passageway means in said rotor communicating said slots with said combustion chamber, whereby the gases from said combustion chamber tend to push said pistons against said vanes to pivot said vanes outwardly.

2. The engine of claim 1 wherein said rotor is provided with recesses in the periphery thereof for receiving said pivoted vanes.

3. The engine of claim 1 wherein said first passageway means are intake and exhaust ports in said annular member opening into said annular wall, and including purge means on said annular wall between the intake and exhaust ports for forcing said vanes to the retracted position and for sealing the area between said intake and exhaust ports.

4. The engine of claim 1 wherein said intermediate member is T-shape in cross section, and wherein said chamber is axially divided by said member into first and second outer sections of the same diameter, and an intermediate third section of reduced diameter.

5. The engine of claim 4 wherein said rotor is of a spool configuration having first and second circular side members of a diameter generally corresponding to that of said first and second sections of said chamber and received therein, and a third circular section between said first and second sections of a lesser diameter than that of said third section of said chamber and received therein.

6. The engine of claim 5 wherein said vanes are on the periphery of said third section of said rotor and engage that portion of the annular wall of said intermediate member defining said third section of said chamber.

7. The engine of claim 1 and including a pair of annular recesses in said annular wall of said intermediate member, rings rotatably received in said recesses, said vanes engaging said rings and said inner surface.

8. The engine of claim 7 and including a pair of rings in each recess, said pair of rings in each recess being concentrically arranged.

9. In a rotary internal combustion engine, a cylindrical housing, said housing comprising an annular, ring-like intermediate member, a pair of end plates, one on each side of said annular member and defining an enclosed rotor chamber therewith, a shaft journaled in said end plates and extending through said chamber, a rotor in said rotor chamber and fixed to said shaft for rotation therewith, said rotor chamber being eccentric relative to said rotor to define a crescent-shaped chamber, pivoted vane elements on said rotor and biased into engagement with the annular wall of said rotor chamber as defined by the inner surface of said annular member, and sequentially forming intake, compression, combustion and exhaust chambers in said crescent shaped chamber, each comprising a body portion pivoted to said rotor and a resilient element for engaging said annular wall, said resilient element including a first elongated section attached to said body member and a second integral section bent back from said elongated section in the reverse direction, said second section engaging said annular wall, and passageway means in said housing to admit fuel to said combustion chamber and air to said intake chamber.

10. The engine of claim 9, wherein said intermediate member is T-shaped in cross section, and wherein said chamber is axially divided by said member into first and second outer sections of the same diameter, and an intermediate third section of reduced diameter.

11. The engine of claim 10, wherein said rotor is of a spool configuration having first and second circular side members of a diameter generally corresponding to that of said first and second sections of said chamber and received therein, and a third circular section between said first and second sections of a lesser diameter than that of said third section of said chamber and received therein.

12. The engine of claim 11, wherein said vanes are on the periphery of said third section of said rotor and engage that portion of the annular wall of said intermediate member defining said third section of said chamber.

13. The engine of claim 9 and including a pair of annular recesses in said annular wall of said intermediate member, rings rotatably received in said recesses, said vanes engaging said rings and said inner surface.

* * * * *